US010046956B2

(12) United States Patent
De Jong

(10) Patent No.: US 10,046,956 B2
(45) Date of Patent: Aug. 14, 2018

(54) LIFTING COLUMN, LIFTING SYSTEM AND METHOD FOR LIFTING A VEHICLE SUCH AS A RAIL-CAR

(71) Applicant: Stertil B.V., Kootstertille (NL)

(72) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 354 days.

(21) Appl. No.: 14/769,854

(22) PCT Filed: Feb. 26, 2014

(86) PCT No.: PCT/NL2014/050116
§ 371 (c)(1),
(2) Date: Aug. 24, 2015

(87) PCT Pub. No.: WO2014/133385
PCT Pub. Date: Sep. 4, 2014

(65) Prior Publication Data

US 2016/0002015 A1 Jan. 7, 2016

(30) Foreign Application Priority Data

Feb. 26, 2013 (NL) ..... 2010365

(51) Int. Cl.

| | |
|---|---|
| ***B66F 5/00*** | (2006.01) |
| ***B66F 7/28*** | (2006.01) |
| ***B66F 9/12*** | (2006.01) |
| ***B66F 9/14*** | (2006.01) |
| ***B61K 5/00*** | (2006.01) |
| ***B66F 3/46*** | (2006.01) |

(52) U.S. Cl.
CPC ..... *B66F 5/00* (2013.01); *B61K 5/00* (2013.01); *B66F 3/46* (2013.01); *B66F 7/28* (2013.01); *B66F 9/122* (2013.01); *B66F 9/147* (2013.01)

(58) Field of Classification Search
CPC ..... B66F 3/46; B61K 5/00
See application file for complete search history.

(56) References Cited

U.S. PATENT DOCUMENTS

| | | | | |
|---|---|---|---|---|
| 4,805,875 A * | 2/1989 | Jackson | B66F 3/24 254/2 R |
| 5,133,531 A * | 7/1992 | Grashoff | B61K 5/04 254/89 H |
| 5,876,018 A * | 3/1999 | Crisp | B61K 5/04 254/124 |
| 2005/0183619 A1* | 8/2005 | Shah | B61K 5/00 104/32.1 |

(Continued)

FOREIGN PATENT DOCUMENTS

| | | |
|---|---|---|
| DE | 202007010387 U1 | 11/2007 |
| DE | 102010015115 A1 | 10/2011 |

(Continued)

*Primary Examiner* — Jason C Smith
(74) *Attorney, Agent, or Firm* — The Webb Law Firm

(57) ABSTRACT

A lifting column, lifting system and method for lifting a vehicle, such as a rail-car. The lifting column includes a frame having a movable carrier; a drive operably connected to the frame for the lifting or lowering of the carrier; and a lifter attached to the carrier for lifting the vehicle to be lifted. The lifter includes a positioner for moving of the lifter relative to the carrier.

10 Claims, 6 Drawing Sheets

(56) References Cited

U.S. PATENT DOCUMENTS

| | | | | |
|---|---|---|---|---|
| 2012/0080653 | A1* | 4/2012 | Gray | B66F 3/24 254/89 R |
| 2016/0002015 | A1* | 1/2016 | De Jong | B66F 7/28 29/426.2 |
| 2016/0039646 | A1* | 2/2016 | Knapp | B66F 3/46 254/89 R |
| 2016/0046470 | A1* | 2/2016 | Benz | B66F 3/46 254/89 R |
| 2016/0185580 | A1* | 6/2016 | Luinge | B66F 3/46 414/800 |
| 2016/0202111 | A1* | 7/2016 | Fahey | B65D 90/143 177/141 |
| 2017/0282941 | A1* | 10/2017 | Lanigan, Sr. | B66F 7/0633 |
| 2018/0002149 | A1* | 1/2018 | Knapp | B66F 11/04 |

FOREIGN PATENT DOCUMENTS

| | | | |
|---|---|---|---|
| FR | 2333745 | A1 | 7/1977 |
| WO | 2006130003 | A1 | 12/2006 |

* cited by examiner

LIFTING COLUMN, LIFTING SYSTEM AND METHOD FOR LIFTING A VEHICLE SUCH AS A RAIL-CAR

CROSS-REFERENCE TO RELATED APPLICATIONS

This application is the United States national phase of International Application No. PCT/NL2014/050116 filed Feb. 26, 2014, and claims priority to Netherlands Patent Application No. 2010365 filed Feb. 26, 2013, the disclosures of which are hereby incorporated in their entirety by reference.

BACKGROUND OF THE INVENTION

Field of the Invention

The present invention relates to a lifting column for lifting a vehicle. The lifting vehicle according to the present invention is especially adapted for lifting a rail-car for transporting goods and/or people over rails.

Description of Related Art

Lifting systems for lifting a rail-car that are known from practice comprise an in-ground lifting cylinder capable of lifting a bogie of a rail-car and/or a rail-car from the rails to gain access to the bogie and/or the wheels that are attached to the bogie of the rail-car. This lifting cylinder engages the rail-car at a point of contact, preferably at the bogie thereof, between the two rail tracks whereon the rail-car is positioned. This restricts the freedom to operate for maintenance personnel, for example. Besides maintenance this may also involve repair of the wheels, shafts and/or bogie, including its components. For example, when a pair of wheels with their connecting shaft needs to be replaced significant effort is required considering that most rail-cars provide at least one bogie on each end of the rail-car. In addition, often each bogie is provided with two or more shafts and corresponding wheels. Since the lifting cylinder typically engages the rail-car and/or bogie between the different shafts of the pairs of wheels access to the shafts and wheels from both sides of the rail-car/bogie is blocked. This significantly hinders maintenance and repair of rail-cars and/or bogies.

Furthermore, replacement of components, repair and/or performing maintenance is restricted to specific locations where an in-ground lifting cylinder is available. Also, these conventional lifting systems cannot be used efficiently in case of a breakdown of a rail-car somewhere along the rails.

SUMMARY OF THE INVENTION

The present invention has for its object to provide a lifting column obviating or at least reducing the aforementioned problems.

This objective is achieved with a lifting column for lifting a vehicle, such as a rail-car, the lifting column according to the present invention comprising:

- a frame comprising a movable carrier;
- a drive operable connected to the frame for the lifting or lowering of the carrier;
- lifting means attached to the carrier for lifting the vehicle to be lifted, the lifting means comprising positioning means for moving of the lifting means relative to the carrier.

By providing a lifting column for lifting a vehicle, such as a rail-car, a rail-car can be lifted from the rails. This is achieved by providing a carrier that can be raised and lowered relative to a mast of the frame of the lifting column. By providing lifting means that are attached to the carrier and can be moved relative to the carrier, the flexibility for positioning the lifting means relative to the vehicle, such as a rail-car for transporting goods and/or persons, is significantly improved. It enables positioning the lifting column and the carrier relative to the vehicle after which the lifting means are brought into contact with the point(s) of contact of the vehicle. This point of contact may comprise several points and/or a contact surface. This improves flexibility as compared to conventional in-ground lifts and/or conventional lifting columns by enabling lifting specific vehicles such as a rail-car by providing lifting means that move relative to the carrier, for example by the positioning means comprising one or more hydraulic cylinders and/or electric actuators.

Preferably, the lifting column according to the present invention comprises moving means, such as rollers or wheels, to enable transfer and positioning of the lifting column relative to the rail-car, thereby achieving a mobile lifting column. This enables positioning the lifting column relative to the rail-car independent of the location of the rail-car. This significantly improves the flexibility for maintenance and repair, including a break-down of the rail-car or bogie somewhere along the rail tracks.

In an alternative embodiment the lifting column according to the present invention is positioned in a pit and/or firmly attached to the ground, for example involving a telescopic cylinder. Optionally, when the lifting column is (partly) provided in a pit it may comprise moving means comprising a guide means, such as a guide rail or guide, and a drive for moving the column in the pit. This provides additional flexibility for the lifting column according to the invention when being applied in a workshop, for example. For safety reasons the pit is preferably provided with a cover.

In a presently preferred embodiment the lifting means comprise a lifting block.

The lifting block can be raised and/or lowered relative to the carrier of the lifting column. Therefore, in use, the lifting block can be moved in a substantially upwards direction, thereby increasing the flexibility of the carrier and the entire lifting operation in this substantially vertical direction. The carrier can be moved in a substantially vertical direction relative to the frame/mast of the lifting column. This enables positioning of the carrier relative to the rail-car, after which the lifting block can be moved in a substantial vertical direction relative to the carrier to engage the point of contact of the rail-car.

By configuring the lifting block such that the lifting block is moveable in a substantial vertical direction relative to the carrier further flexibility is added to the lifting column according to the invention.

In a presently preferred embodiment, the carrier is provided with a recess for receiving the lifting block.

By providing a recess, including an opening in the carrier, such that the lifting block can be received it is possible to position the carrier relative to the point of contact of the rail-car after which the lifting block can be moved to engage the point of contact. This improves the flexibility for positioning the lifting means and the carrier of the lifting column according to the present invention.

In a further preferred embodiment according to the present invention, the lifting means comprise two or more lifting arms.

By providing one or more, preferably two, lifting arms the bogie and/or rail-car can be lifted with the lifting arms engaging the bogie and/or rail-car. Preferably, the lifting arms are extendable relative to the carrier. More preferably, in use, the lifting arms are extendable in a substantially horizontal direction that is substantially perpendicular to the moving direction of the carrier relative to the frame/mast. This further improves the flexibility of positioning the lifting means.

By configuring the lifting arms such that the lifting arms can be extended in a substantial horizontal direction relative to the frame further flexibility is added to the lifting column according to the invention. The lifting arms are extendable in a substantial horizontal direction towards the vehicle or structure to be lifted.

Optionally, an additional side shift mechanism is provided to enable the lifting arms to be moveable in a substantial horizontal direction substantially alongside the vehicle or structure to be lifted. This direction is substantially perpendicular to the direction wherein the lifting arms can be extended and the vertical direction. This further improves the flexibility of the lifting column according to the invention.

In a presently preferred embodiment the lifting means both comprise the lifting block and the lifting arms to enable approaching a point of contact in both a substantial vertical and a substantial horizontal direction with the carrier maintaining its position. The lifting arms and the lifting block are preferably independently capable of lifting the load. In a preferred embodiment comprising both the lifting arms and the lifting block the flexibility of the lifting column is further increased.

In such preferred embodiment lifting arms can be extended through openings in the vehicle or structure to be lifted. This positions the carrier in the substantial vertical direction. The lifting block can be lifted from the carrier to engage a frame of the vehicle or structure to be lifted, for example. As a next step the carrier can be raised and the vehicle or structure is lifted. Preferably the lifting block and lifting arms can be controlled independently and can be used in combination or alone.

In a further preferred embodiment according to the present invention the carrier comprises horizontal positioning means for moving the carrier relative to the frame in a substantial horizontal direction.

By enabling the carrier to independently move relative to the frame the freedom for positioning the lifting block and/or the lifting arms is further improved. This increases the flexibility when lifting a load. The positioning means may comprise a guide rail, for example.

In a presently preferred embodiment according to the present invention the lifting column further comprises locking means for locking the lifting means when in use.

By providing locking means, such as a pen, screw or the like, the lifting means can be firmly locked when in use. This can be relevant when the surface on which the lifting columns are positioned is not entirely flat and/or the weight distribution over the rail-car is irregular. This provides additional safety, thereby preventing accidents, for example.

This invention further relates to a lifting system comprising one or more lifting columns as described above.

Such a lifting system provides the same effects and advantages as those stated with reference to the lifting column. The lifting system preferably uses two or more lifting columns, more preferably operating in pairs, for lifting one end of a rail-car. Preferably two lifting columns are positioned each on one side of the rail-car on one of its ends at the location of a so-called bogie of the rail-car.

When the entire bogie needs to be replaced, the frame or housing of the rail-car is lifted after which the bogie is removed. Before lifting the frame or housing of the rail-car the bogie needs to be decoupled from the housing.

Alternatively, the bogie is lifted together with the frame or housing of the rail-car after which the wheels with shafts can be removed from the rail-car. Before lifting the bogie the wheels with shafts have been decoupled from the bogie.

The invention furthermore also relates to a method for lifting a vehicle, such as a rail-car, comprising a lifting column and/or lifting system as described above, the method comprising the steps:

- positioning the one or more lifting columns relative to the vehicle to be lifted;
- decoupling wheels and shafts and/or a bogie from the vehicle;
- lifting the vehicle; and
- moving and/or replacing and/or providing maintenance of the wheels and shafts and/or the bogie.

Such method provides the same effects and advantages as those stated with reference to the lifting column and/or lifting system.

In a preferred embodiment decoupling the wheels and shaft(s) comprises decoupling the shaft(s) from the bogie of the vehicle to be lifted.

In an alternative embodiment the entire bogie is decoupled from the housing of the vehicle to be lifted, such that the bogie can be removed from the rail-car.

In a preferred embodiment lifting the vehicle comprises moving the lifting block relative to the carrier and engaging the lifting block with a point of contact of the vehicle. Alternatively, or in addition thereto, lifting the vehicle comprises moving one or more, preferably two, lifting arms relative to the carrier and engaging the lifting arms with the points of contact of the vehicle. This improves the overall flexibility when lifting the vehicle.

In a presently preferred embodiment after decoupling the wheels and lifting the rail-car, the wheels, or more specifically a pair of wheels that are connected with a shaft, can be moved into one direction relative to the vehicle. This is especially relevant when shafts or wheels need to be replaced and the rail-car comprises a housing and a bogie with the shafts being connected to the bogie. By lifting the rail-car with the bogie, using the lifting column(s) according to the present invention, it is possible to move all shafts with the wheels connected thereto into the same direction, preferably away from the rail-car without being hindered by the lifting column or other structural part required for lifting the bogie and/or housing of the rail-car. Preferably, moving the wheels involves moving the wheels over rails that are being used for moving the rail-car.

BRIEF DESCRIPTION OF THE DRAWINGS

Further advantages, features and details of the invention are elucidated on the basis of preferred embodiments thereof, wherein reference is made to the accompanying drawings, in which.

DESCRIPTION OF THE INVENTION

Figure 1:
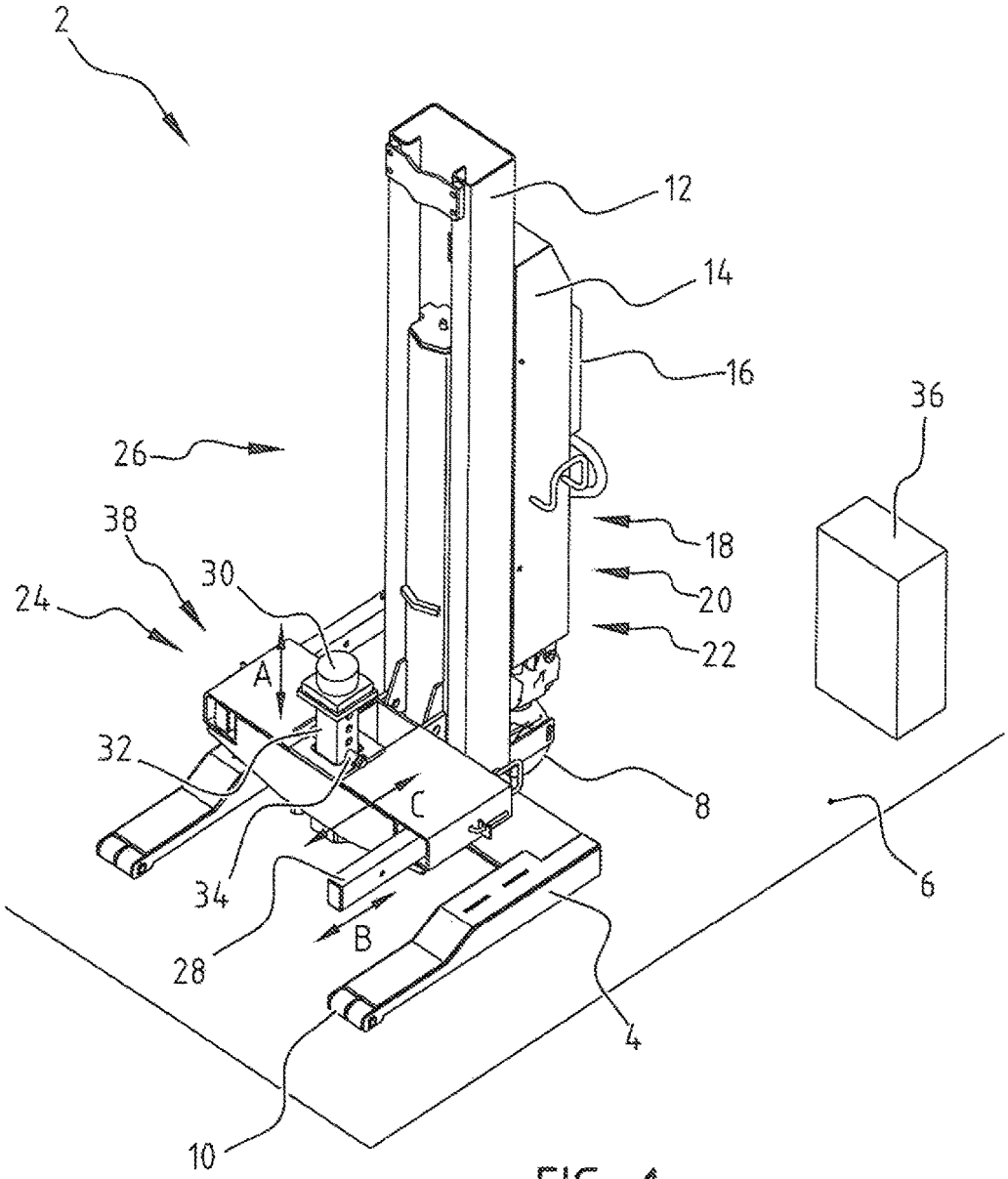
FIG. 1 shows an embodiment of a lifting column according to the invention.

Lifting column 2 (FIG. 1) comprises a foot 4 that is positioned on surface 6. Lifting column 2 can be moved over ground surface 6 using main wheel 8 and front wheels 10. Lifting column 2 comprises a mast 12 on which a control box 14 with a display and input device 16 is attached. Control box 14 further comprises transmitter/receiver 18, drive 20 and in the illustrated mobile embodiment battery 22. Furthermore, mast 12 comprises a height sensor 26 for detecting the actual height of the carrier 24 that can be moved along mast 12 using a conventional hydraulic scheme, for example. In particular, sensor 26 enables detecting height differences between carriers 24 of individual lifting columns 2 that jointly lift a vehicle.

In the illustrated embodiment carrier 24 is provided with two lifting arms 28 that are extendable relative to carrier 24. In addition, carrier 24 comprises a lifting block 30 that can be lifted with lift 32. In the illustrated embodiment locking means 34 use a pen to provide additional safety when lifting a vehicle. In the illustrated embodiment lifting column 2 communicates with central controller 36 that controls the operation of lifting column 2 and preferably also the joint operation of a pair of lifting columns 2 when lifting a vehicle.

In the illustrated embodiment lifting block 30 is moveable in a substantially vertical direction A. Lifting arms 28 are moveable in a substantially horizontal direction B and, in addition, carrier 24 is moveable with guide 38 in a substantially horizontal direction C relative to lifting arms 28. These possibilities for moving carrier 24, arms 28 and/or block 30 increase the freedom to position lifting block 30 when lifting a load.

In the illustrated embodiment a central controller 36 controls operation of lifting columns 2. In addition thereto, or as an alternative there for, the control can be performed directly on lifting columns 2.

Figure 2A:
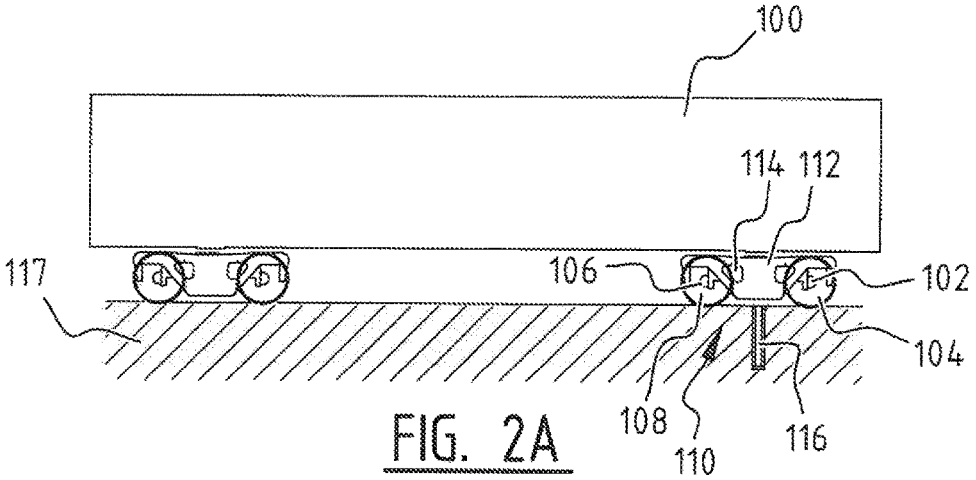
FIG. 2A PRIOR ART
FIGS. 2A-C show a lifting system according to the prior art.

Rail-car 100 (FIG. 2A) comprises a number of shafts 102 connecting a pair of wheels 104. A second shaft 106 connects a second pair of wheels 108. Both the first shaft 102 and the second shaft 106 are connected to bogie 110 with frame 112. Bogie 110 is provided with a number of openings 114 enabling access to components of bogie 110.

Figure 2B:
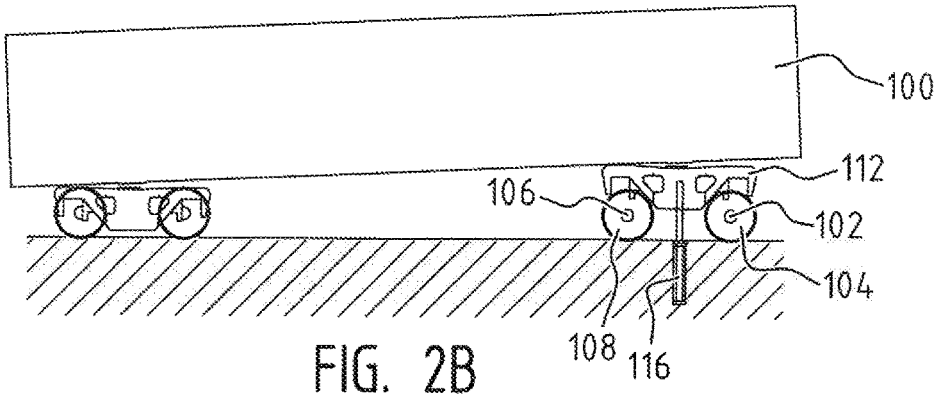
FIG. 2B PRIOR ART
Figure 2C:
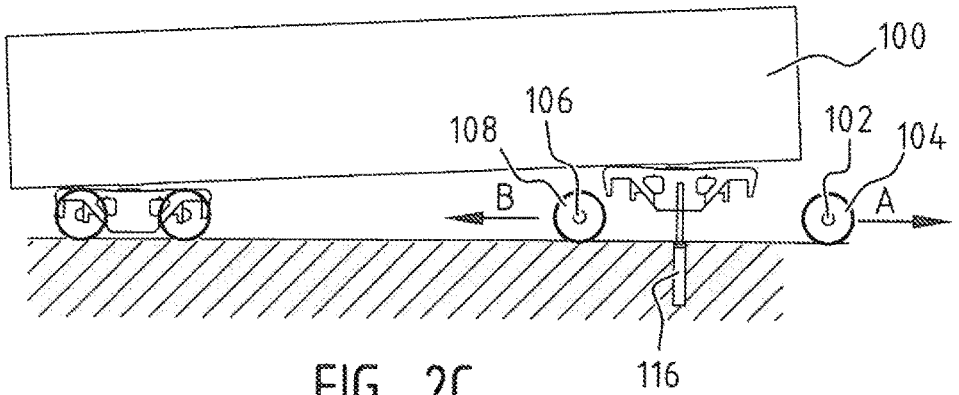
FIG. 2C PRIOR ART

According to the prior art a conventional in-ground lifting cylinder 116 (FIGS. 2A-C) is positioned in ground surface 117 and specifically between the rails over which wheels 104, 108 move. When wheels 104, 108 with shafts 102, 106 need to be removed, lifting cylinder 116 lifts bogie 110 after decoupling shafts 102, 106 from bogie 110. After the bogie 110 is lifted (FIG. 2B) the wheels can be rolled away from bogie 110 (FIG. 2C). In the illustrated embodiment first shaft 102 is rolled away to the right hand side while the second shaft 106 is rolled away in the opposite direction towards the left hand side (FIG. 2C). Especially when replacing shaft 106 and all wheels 108 on the left hand side a relatively complex operation for providing a new shaft and/or new wheels is required as cylinder 116 blocks access for a new shaft and new pair of wheels.

Figure 3A:
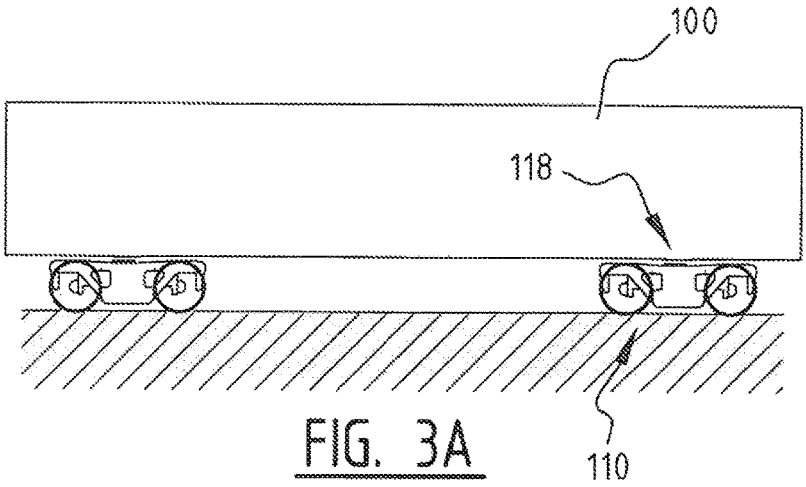
FIGS. 3A-C schematically illustrate removing a bogie from a rail-car with the lifting column of FIG. 1.
Figure 3B:
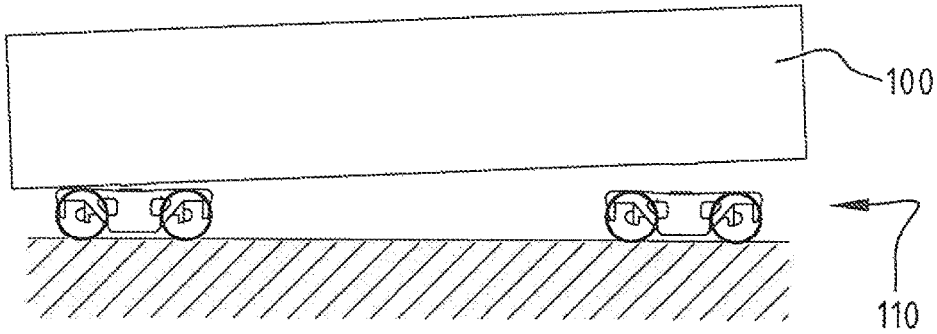
Figure 3C:
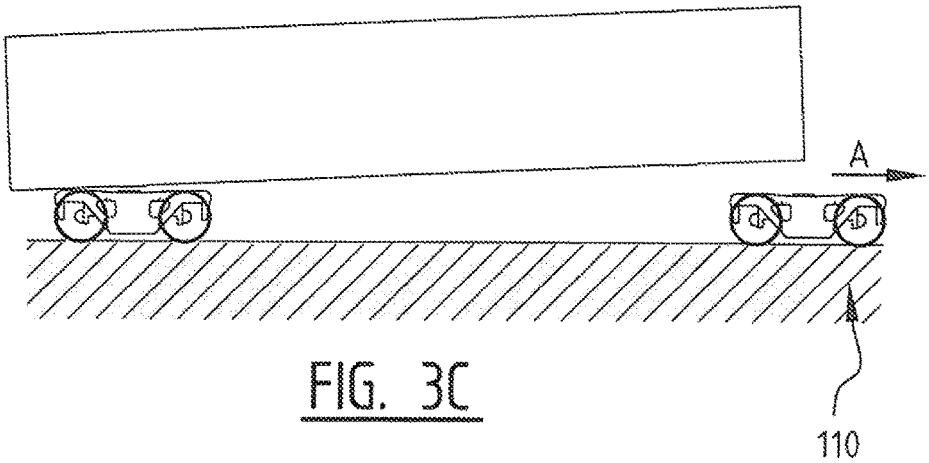

A rail-car 100 (FIGS. 3A-C) can be lifted by removing nut 118 from a central pivot of bogie 110 and disconnecting brake lines etc. (not shown). Using lifting column 2 wagon 100 can be lifted from bogie 110, preferably using two mobile lifting columns 2 on one end of rail-car 100. For example, rail-car 100 can be lifted over a substantially vertical distance of 400 mm (FIG. 3B) after which bogie 110 can be rolled away to be surfaced at another location in a direction A (FIG. 3C).

Figure 4A:
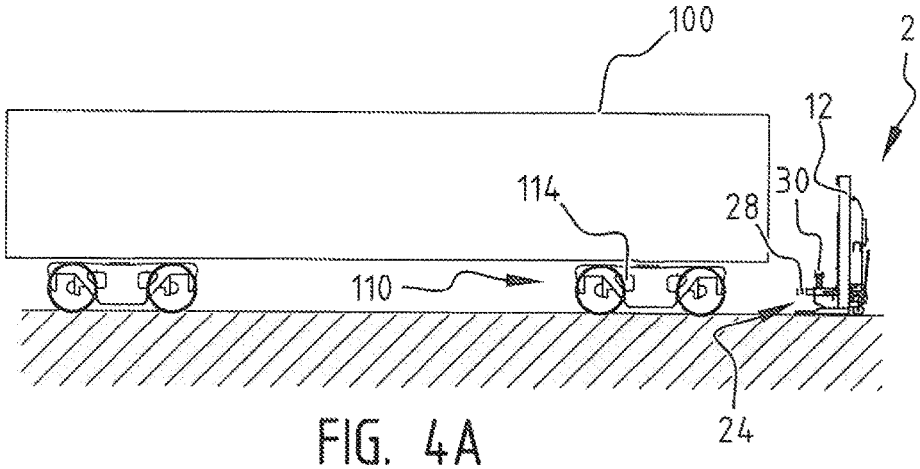
FIGS. 4A-C schematically illustrate removing the wheels from a bogie with a lifting column according to FIG. 1.

When shaft 102, 106 with wheels 104, 108 needs to be removed from bogie 110, one or more lifting columns 2 are positioned relative to the rail-car 100. When lifting rail-car 100 (FIG. 4A-C) the carrier 24 is positioned relative to the bogie after which lifting means engage the point of contact of bogie 110 and/or housing of rail-car 100. When lifting arms 28 are being used these lifting arms 28 are preferably provided in openings 114 after which carrier 24 can be lifted. Alternative points of contact can also be engaged by lifting arms 28. This enables changing wheels 104, 108 and/or shafts 102, 106 without removing the entire bogie 110.

Figure 4B:
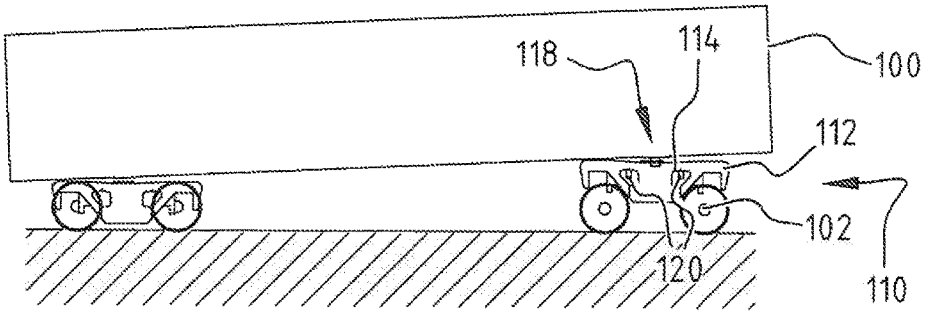
Figure 4C:
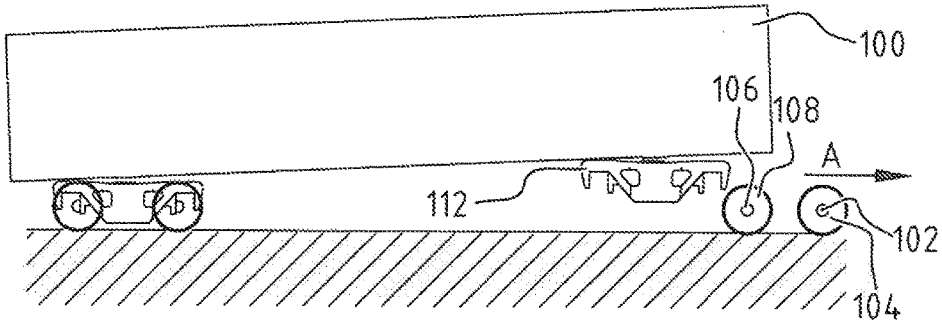

In case lifting column 2 with lifting arms 28 is being used to lift rail-car 100, lifting block 30 engages the point of contact 118 in the housing or wagon of rail-car 100. Lifting arms 28 engage additional points of contact 120 of bogie 110 (FIG. 4B). When bogie 110 and the housing of rail-car 100 are being lifted, all shafts 102, 106 and the wheels 104, 108 connected thereto can be moved away from the rail-car 100 in the same direction A (FIG. 4C). This provides easy access for removing and/or replacing wheels and shafts as there is no structural element, such as a cylinder, blocking their movements relative to rail-car 100.

For example, lifting block 30 engages the frame of rail-car 100 and lifting arms 28 are positioned in openings of bogie 110 by extending lifting arms 28. This provides additional safety when lifting rail car 100 for changing wheels 104, 108 and/or shafts 102, 106 without removing the entire bogie 110. Alternatively, lifting block 30 engages the frame of rail-car 100 and lifts the frame of bogey 110 to enable changing the entire bogie 110, for example.

Figure 5:
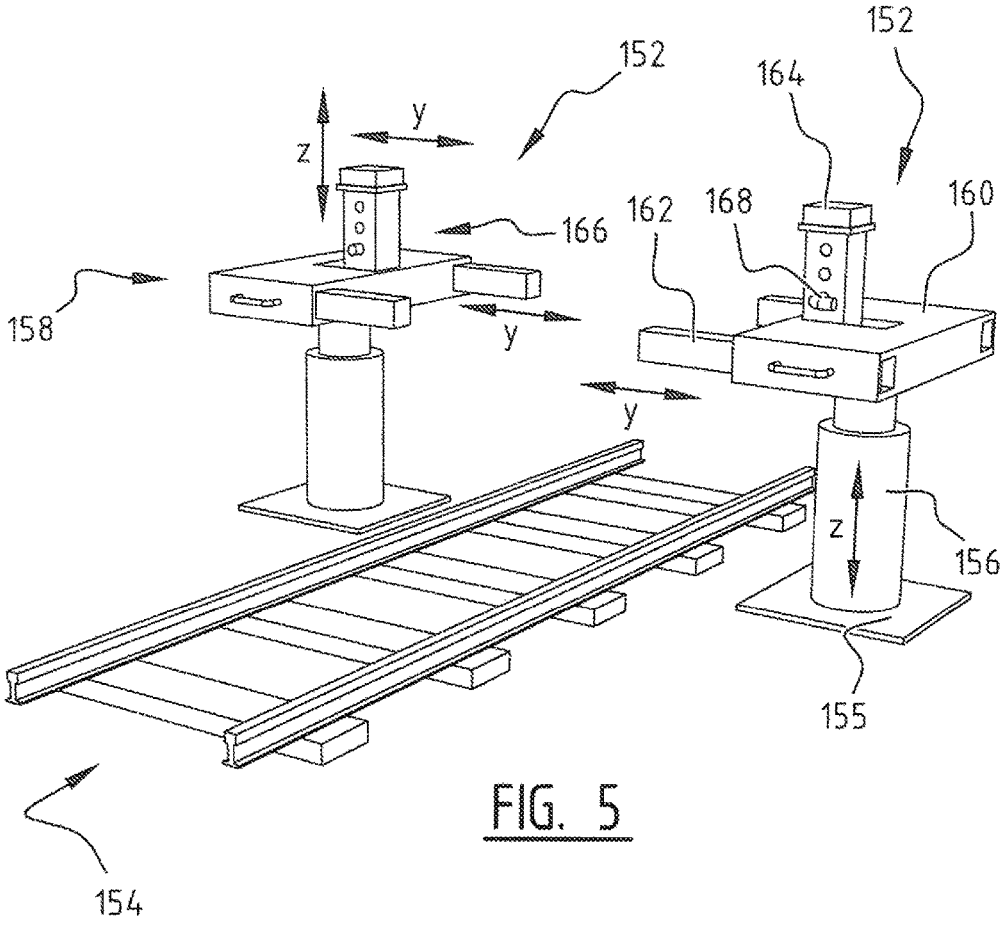
FIG. 5 shows an alternative embodiment of a lifting column according to the invention.

Lifting column 152 (FIG. 5) is positioned adjacent railway 154 in the illustrated embodiment. Column 152 is connected to base 155 and comprises hydraulic cylinder 156 that in a retracted position is substantially positioned in-ground. Carrier 158 comprises platform 160 that is provided with lifting arms 162 suitable for engaging a bogie of a rail-car, and lifting block 164 suitable for engaging a frame of a rail-car. In the illustrated embodiment lifting block 164 is moveable in height direction (z-direction) relative to platform 160 of carrier 158. Also, lifting block 164 is moveable in a substantially horizontal direction (y-direction) towards or away from the object to be lifted with moving mechanism 166 comprising a drive and guides. Height adjustments can be locked with locking mechanism 168.

Figure 6:
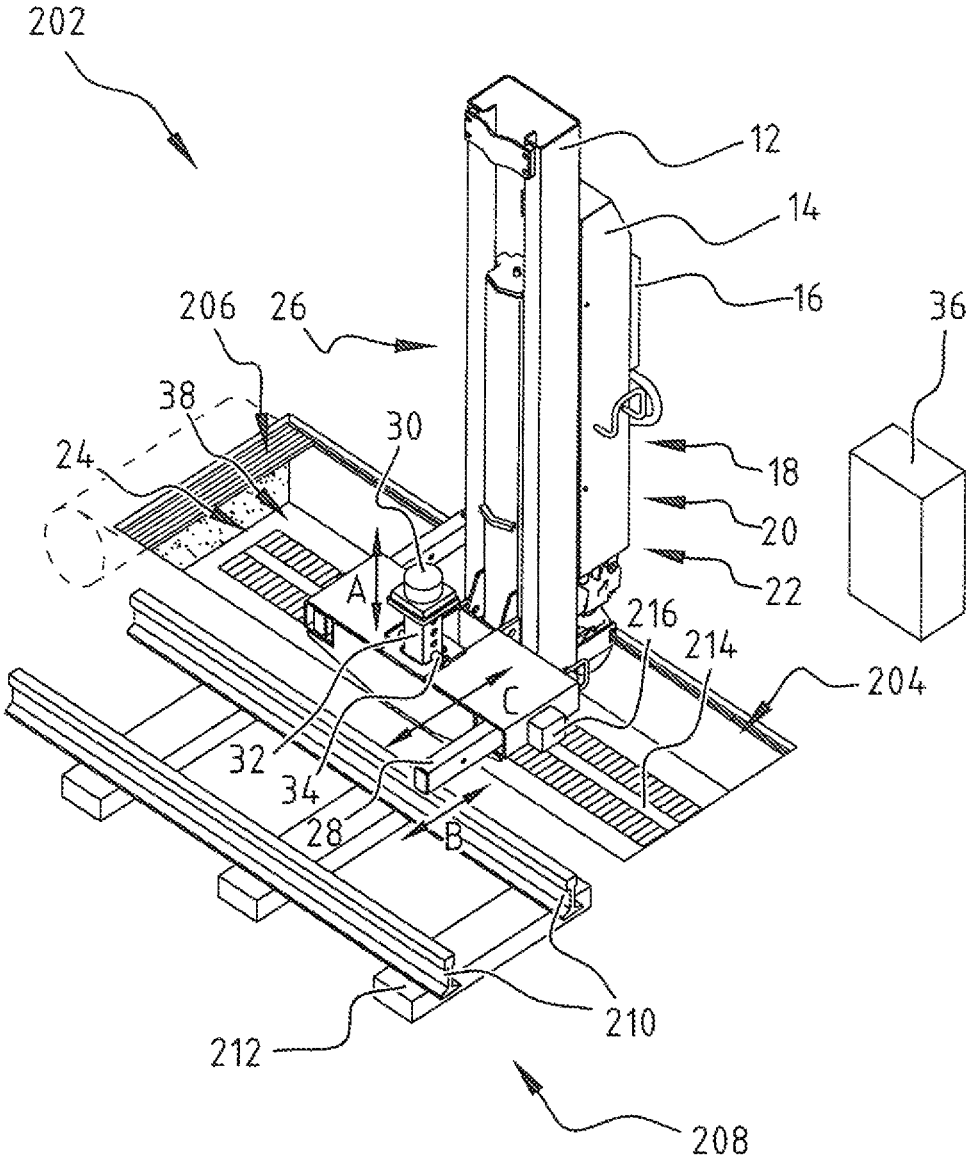
FIG. 6 shows a further alternative embodiment of a lifting column according to the invention in a pit.

In-ground lifting column 202 (FIG. 6) comprises similar structures and elements as compared to lifting column 2 that is described earlier. Therefore, in-ground lifting column 202 will mainly be described in relation to its relevant and/or its distinguishing elements. Similar elements will be indicated with the same reference numbers.

In the illustrated embodiment in-ground lifting column is partly positioned in pit 204 that is provided with cover 206. Cover 206 can be any conventional cover that is used for in-ground lifting systems. In the illustrated embodiment cover 206 is positioned on one or both ends of pit 204. Alternatively, cover 206 is connected to column 202 such that a substantially continuous coverage of pit 204 is achieved irrespective of the actual position of column 202 in pit 204. Pit 204 is located directly besides railway 208 with its rails 210 and railway sleepers/ties 212. Pit 204 is provided with guide 214 and drive 216 enabling movement of column 202 along pit 204 for positioning relative to a rail-car. It will be understood that in-ground lifting column 202 can alternatively be provided at a specific location, in other words without being moveable. Furthermore, it will be understood that other embodiments of column 202 could also be applied according to the invention, including embodiments of column 2 that only comprise lifting arms 28 or lifting block 30. Furthermore, it will also be understood that lifting column 202 can be positioned between rails 210, optionally in a pit 204. Also, lifting column 202 can be used in other applications such as for lifting road vehicles, for example.

The present invention can be applied to the (wireless) lifting columns as illustrated in FIG. 1. Alternatively, the invention can also be applied to other types of lifting columns and lifting systems including wired lifting columns.

The present invention is by no means limited to the above described preferred embodiments thereof. The rights sought are defined by the following claims within the scope of which many modifications can be envisaged.

The invention claimed is:

1. A lifting column for lifting a vehicle, comprising:

a frame comprising a movable carrier;

a drive operably connected to the frame for the lifting or lowering of the carrier;

a lifter attached to the carrier for lifting the vehicle to be lifted, the lifter comprising a positioner for moving of the lifter relative to the carrier;

wherein the lifter comprises one or more lifting arms; and wherein the lifting arms are extendable relative to the carrier.

2. The lifting column according to claim 1, wherein the lifter comprises a lifting block that is configured such that the lifting block is moveable in a substantially vertical direction relative to the carrier.

3. The lifting column according to claim 2, wherein the carrier comprises a recess for receiving the lifting block.

4. The lifting column according to claim 1, wherein the lifting arms are configured such that the lifting arms are moveable in a substantially horizontal direction relative to the frame.

5. The lifting column according to claim 1, further comprising a side shift mechanism configured to position the lifting arms in a substantially sideways direction.

6. The lifting column according to claim 1, wherein the carrier comprises horizontal positioners configured to move the carrier relative to the frame in a substantially horizontal direction.

7. The lifting column according to claim 1, further comprising a lock configured to lock the lifter when in use.

8. The lifting column according to claim 1, further comprising a mover configured to move the lifting column.

9. The lifting column according to claim 8, further comprising a guide and a drive for moving the column in a pit.

10. The lifting system for lifting a vehicle, comprising at least two lifting columns according to claim 1.

* * * * *